US007492333B2

(12) United States Patent
Lee et al.

(10) Patent No.: US 7,492,333 B2
(45) Date of Patent: Feb. 17, 2009

(54) PLASMA DISPLAY DEVICE AND DRIVING METHOD THEREOF

(75) Inventors: Jun-Young Lee, Suwon-si (KR); Jae-Woon Lee, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 685 days.

(21) Appl. No.: 11/116,449

(22) Filed: Apr. 28, 2005

(65) Prior Publication Data

US 2006/0038749 A1 Feb. 23, 2006

(30) Foreign Application Priority Data

Aug. 18, 2004 (KR) ..... 10-2004-0065061

(51) Int. Cl.
*G09G 3/28* (2006.01)

(52) U.S. Cl. ..... 345/60; 315/169.4

(58) Field of Classification Search ..... 345/60–72, 345/211; 315/169.1, 169.4
See application file for complete search history.

(56) References Cited

U.S. PATENT DOCUMENTS

| | | | | |
|---|---|---|---|---|
| 4,866,349 | A | 9/1989 | Weber et al. | |
| 5,081,400 | A | 1/1992 | Weber et al. | |
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,111,556 | A | 8/2000 | Moon | |
| RE37,444 | E | 11/2001 | Kanazawa | |
| 6,317,122 | B1 * | 11/2001 | Yamazaki | 345/211 |
| 6,630,916 | B1 | 10/2003 | Shinoda | |
| 6,707,436 | B2 | 3/2004 | Setoguchi et al. | |

FOREIGN PATENT DOCUMENTS

| | | |
|---|---|---|
| CN | 1284702 | 2/2001 |
| CN | 1430196 | 7/2003 |
| JP | 02-148645 | 6/1990 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Amare Mengistu
*Assistant Examiner*—Kenneth B Lee, Jr.
(74) *Attorney, Agent, or Firm*—Robert E. Bushnell, Esq.

(57) ABSTRACT

In a plasma display device and driving method thereof, a voltage of a power recovery capacitor at rising voltage is established to be higher than a middle voltage of a sustain discharge voltage, and a voltage of the capacitor at falling voltage is established to be lower than the middle voltage thereof in a power recovery circuit. Therefore, the time used for voltage rising and voltage falling in the power recovery operation is reduced.

14 Claims, 10 Drawing Sheets

FOREIGN PATENT DOCUMENTS

| | | |
|---|---|---|
| JP | 10-011019 | 1/1998 |
| JP | 2845183 | 10/1998 |
| JP | 2917279 | 4/1999 |
| JP | 2001-043804 | 2/2001 |
| JP | 2001-325888 | 11/2001 |

* cited by examiner

PLASMA DISPLAY DEVICE AND DRIVING METHOD THEREOF

CLAIM OF PRIORITY

This application makes reference to, incorporates the same herein, and claims all benefits accruing under 35 U.S.C. §119 from an application for PLASMA DISPLAY DEVICE AND DRIVING METHOD THEREOF earlier filed in the Korean Intellectual Property Office on 18 Aug. 2004 and there duly assigned Serial No. 10-2004-0065061.

BACKGROUND OF THE INVENTION

1. Technical Field

The present invention relates to a plasma display device and a driving method thereof and, in particular, to a power recovery circuit of a plasma display device.

2. Related Art

Plasma display devices are flat panel displays that use plasma generated by gas discharge to display characters or images. The plasma display devices include, according to their size, more than several tens to millions of pixels arranged in the form of a matrix. These plasma display devices are classified into a direct current (DC) type and an alternating current (AC) type according to patterns of waveforms of driving voltages applied thereto and discharge cell structures thereof.

An AC plasma display panel (PDP) has scan electrodes and sustain electrodes in parallel on one side thereof, and has address electrodes crossing the scan electrodes and sustain electrodes on another side thereof. The sustain electrodes are formed to correspond to the respective scan electrodes, one terminal of each being coupled in common. In general, a method for driving the AC plasma display panel can be expressed in terms of temporal operation periods, i.e., a reset period, an address period, and a sustain period.

The reset period is a period in which the state of each cell is reset such that an addressing operation of each cell is smoothly performed, and the address period is a period in which an address voltage is applied to an addressed call in order to accumulate wall charge on the addressed cell so as to select a cell to be turned on and a cell not to be turned on in the plasma display panel (PDP). The sustain period is a period in which sustain discharge voltage pulses are applied to the addressed cell, thereby causing a discharge according to which a picture is actually displayed.

Since there is a discharge space between a scan electrode and a sustain electrode, and since there is a discharge space between a surface on which an address electrode is formed and a surface on which scan and sustain electrodes are formed, these spaces operate as capacitive loads (referred to as panel capacitors hereinafter), and capacitance exists on the panel. Hence, charge-injecting reactive power for generating a predetermined voltage for the capacitance is needed, in addition to power for a sustain discharge in order to apply waveforms for the sustain discharge. Therefore, a sustain discharge circuit includes a power recovery circuit for recovering the reactive power and re-using the same, such power recovery circuits being disclosed by L. F. Weber in U.S. Pat. Nos. 4,866,349 and 5,081,400. The power recovery circuits of Weber fail to recover 100% of the reactive power because of loss caused by switching in the power recovery circuits, and it is accordingly difficult to increase the sustain discharge voltage to the voltage of Vs or decrease the same to 0V. When a switch for supplying the voltage of Vs or 0V is turned on, the switch performs hard switching to thus generate a switching loss and an EMI. Furthermore, the time for applying the sustain discharge pulse in the reset period or the address period is short since the time for increasing the sustain discharge pulse from 0V to Vs, and the time for decreasing the same from Vs to 0V, are long.

The information disclosed above is only for the purpose of enhancing understanding of the background of the invention, and therefore, unless explicitly described to the contrary, it should not be taken as an acknowledgment, or any form of suggestion, that this information forms the prior art that is already known to a person of ordinary skill in the art.

SUMMARY OF THE INVENTION

The present invention has been developed in an effort to provide a plasma display device and driving method thereof having the advantage of reducing voltage variation time.

The present invention has also been developed in an effort to provide a plasma display device driving method having the advantage of reducing switching loss in a power recovery circuit.

In one aspect of the present invention, a plasma display device comprises a panel and a driving circuit. The panel includes a plurality of first electrodes and second electrodes, and the driving circuit outputs a signal for driving the first electrode. The driving circuit comprises a first switch, a second switch, at least one inductor, a third power source, a third switch, a fourth power source, and a fourth switch. The first switch is coupled between a first power source and a first electrode for supplying a first voltage to the first electrode in a sustain period. The second switch is coupled between a second power source and the first electrode for supplying a second voltage, lower than the first voltage, to the first electrode in the sustain period. The inductor(s) has (have) a first terminal coupled to the first electrode. The third power source supplies a third voltage, which is higher than half the difference between the first voltage and the second voltage. The third switch has a first terminal coupled to the third power source and a second terminal coupled to a second terminal of the inductor(s). The fourth power source supplies a fourth voltage, which is lower than half the difference between the first voltage and the second voltage. The fourth switch has a first terminal coupled to the fourth power source and a second terminal coupled to the second terminal of the inductor(s). The driving circuit includes a first capacitor, a floating power source, and a second capacitor coupled in series between a fifth power source for supplying a fifth voltage and a sixth power source for supplying a sixth voltage. The third power source includes the floating power source and the second capacitor, and the fourth power source includes the second capacitor. The driving circuit uses resonance of the inductor (s) and the first electrode, generated when the third switch is turned on during a sustain period, to increase a voltage at the first electrode, and the driving circuit uses resonance of the inductor(s) and the first electrode, generated when the fourth switch is turned on during a sustain period, to decrease the voltage at the first electrode to the second voltage.

In another aspect of the present invention, a plasma display device comprises a panel and a driving circuit. The panel includes a plurality of first electrodes and second electrodes, and the driving circuit outputs a signal for driving the first electrode. The driving circuit comprises at least one inductor, a first capacitor, a floating power source, and a second capacitor. The inductor(s) has (have) a first terminal coupled to the first electrode. The first capacitor, the floating power source, and the second capacitor are coupled in series between a first power source for supplying a first voltage and a second power source for supplying a second voltage.

A first path is formed from a node between the first capacitor and the floating power source to the inductor(s), and increases a voltage at the first electrode. A second path is formed for applying a third voltage, supplied by a third power source to the first electrode. A third path is formed from the inductor(s) to a node between the floating power source and the second capacitor, and reduces a voltage at the first electrode. A fourth path is formed for applying a fourth voltage, supplied by a fourth power source, to the first electrode. The first path is formed when a first switch, coupled between the inductor(s) and the node of the first capacitor and the floating power source, is turned on. The third path is formed when a second switch, coupled between the inductor(s) and the node of the second capacitor and the floating power source, is turned on. The second path is formed when a third switch, coupled between the third power source and the first electrode, is turned on. The fourth path is formed when a fourth switch, coupled between the fourth power source and the first electrode, is turned on.

In still another aspect of the present invention, there is provided a plasma display device driving method which uses an inductor coupled to a first electrode, and alternately applies a first voltage and a second voltage to the first electrode, a panel capacitor being formed by the first electrode and the second electrode. In the method, a third voltage, which is higher than an average of the first voltage and the second voltage, is used to generate resonance between the panel capacitor and the inductor, and a voltage at the first electrode is increased; the first voltage is applied to the first electrode; a fourth voltage, which is lower than the average thereof, is used to generate resonance between the panel capacitor and the inductor, and a voltage at the first electrode is decreased; and the second voltage is applied to the first electrode. The fourth voltage is supplied by a first capacitor charged with the fourth voltage, and the third voltage is supplied by the first capacitor and a floating power source coupled to the first capacitor. The first capacitor, the floating power source, and the second capacitor are coupled in series between a first power source for supplying the first voltage and a second power source for supplying the second voltage. The third voltage is supplied by the floating power source, and the fourth voltage is supplied by the second capacitor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE EMBODIMENTS

Figure 1:
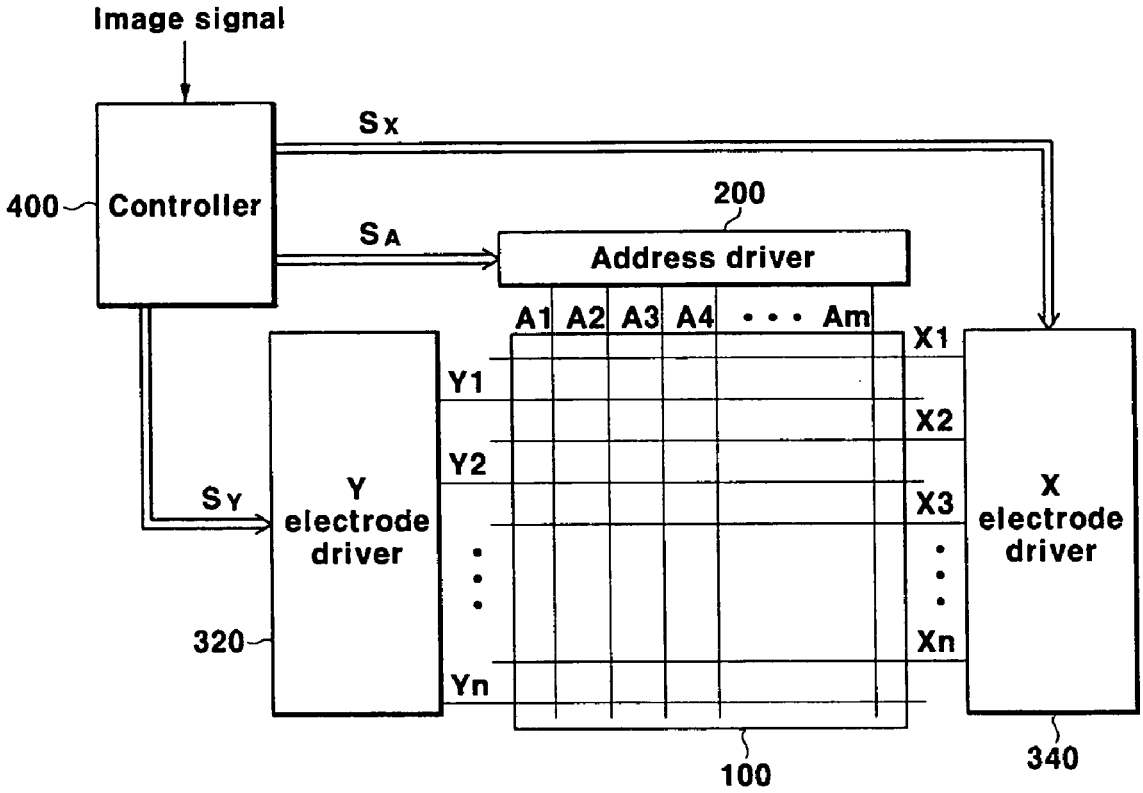
FIG. 1 shows a plasma display device according to an embodiment of the present invention.

In the following detailed description, exemplary embodiments of the present invention are shown and described by way of illustration. As those skilled in the art will recognize, the described exemplary embodiments maybe modified in various ways, all without departing from the spirit or scope of the present invention. Accordingly, the drawings and description are to be regarded as illustrative in nature, rather than restrictive. In the drawings, illustrations of elements having no relation to the present invention are omitted in order to more clearly present the subject matter of the present invention. In the specification, the same or similar elements are denoted by the same reference numerals even though they are depicted in different drawings.

A configuration of a plasma display device according to an embodiment of the present invention will now be described with reference to FIG. 1, which shows a plasma display device according to an embodiment of the present invention. As shown in FIG. 1, the plasma display device includes a plasma display panel 100, an address driver 200, a Y electrode driver 320, an X electrode driver 340, and a controller 400.

The plasma display panel 100 includes a plurality of address electrodes A1 to Am in the column direction, and first sustain electrodes Y1 to Yn and second sustain electrodes X1 to Xn alternately arranged in the row direction. The address driver 200 receives an address driving control signal (SA) from the controller 200, and applies to the address electrodes Al to Am a display data signal for selecting a discharge cell to be displayed. The Y electrode driver 320 and the X electrode driver 340 receive a Y electrode driving signal (SY) and an X electrode driving signal (SX), respectively, from the controller 200, and apply the same to the first sustain electrodes Y1 to Ym and to the second sustain electrodes X1 to Xm, respectively. The controller 400 receives an external image signal, generates an address driving control signal (SA), the Y electrode driving signal (SY), and the X electrode driving signal (SX), and transmits the same to the address driver 200, the Y electrode driver 320, and the X electrode driver 340, respectively.

The configuration and operation of the Y electrode driver 320 according to an embodiment of the present invention will now be described.

Figure 2:
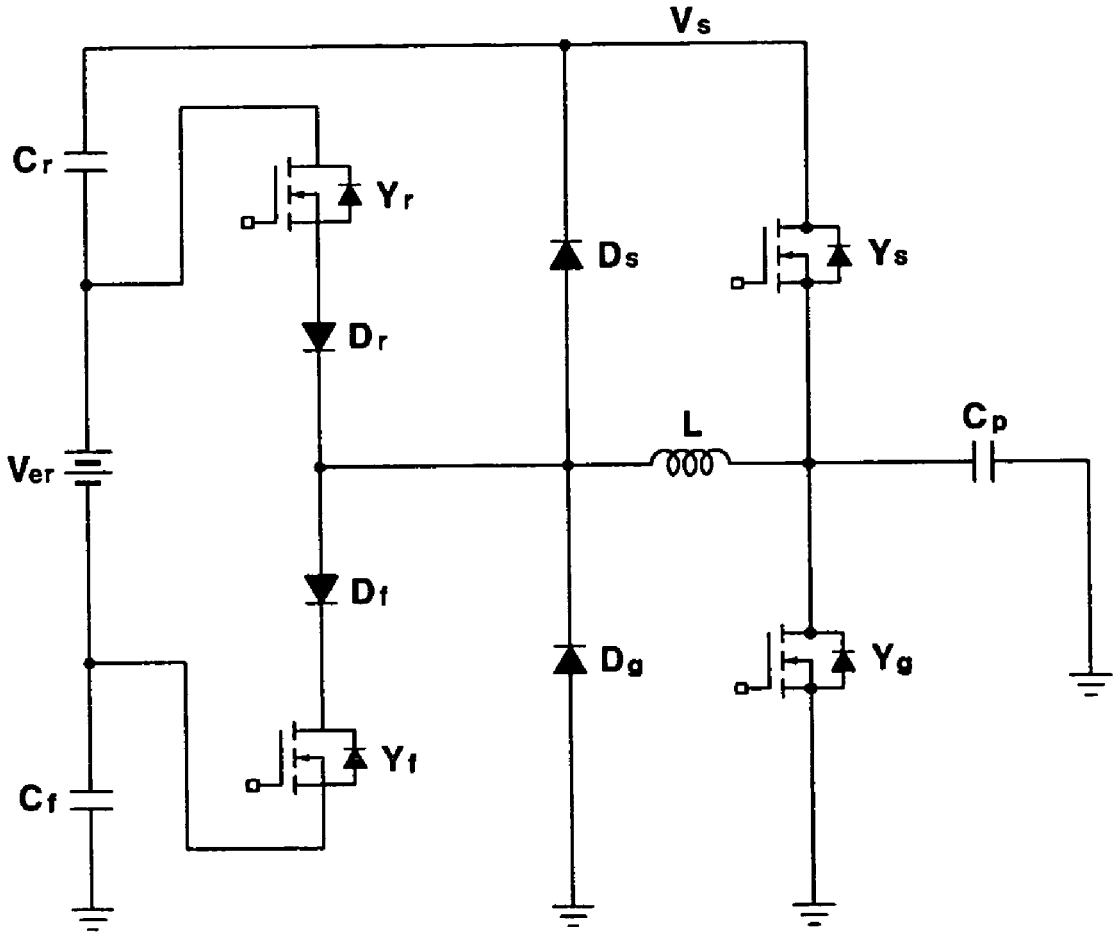
FIG. 2 shows a circuit diagram of a Y electrode driver according to an embodiment of the present invention.

FIG. 2 shows a circuit diagram of a Y electrode driver according to an embodiment of the present invention.

As shown in FIG. 2, the Y electrode driver 320 includes an inductor L, switches Ys and Yg coupled in series between a voltage of Vs and the ground, diodes Ds and Dg coupled in series between the voltage of Vs and the ground, and switches Yr and Yf, diodes Dr and Df, capacitors Cr and Cf, and a power source Ver for forming a power recovery circuit. The power source Ver has a positive terminal coupled to a drain of the switch Yr and a negative terminal coupled to a source of the switch Yf, the capacitor Cr is coupled between the power source Vs and the power source Ver, and the capacitor Cf is coupled between the power source Ver and the ground. The diode Dr and the diode Df are coupled in series between the source of the switch Yr and the drain of the switch Yf. NMOS transistors forming body diodes are used as the switches Yr, Yf, Ys, and Yg, and other transistors are also applicable.

A time-variant operation of a driving circuit in a sustain period will be described below with reference to FIG. 3 and FIG. 4A to 4F. The operation has six modes, M1 to M6, which are changed by the operation of switches. A phenomenon referred to as resonance does not indicate continuous oscillation, but represents a change of voltage and current caused by the combination of the inductor L and the panel capacitor Cp when the switches Yr and Yf are turned on. A threshold voltage will be approximated to be 0V since threshold voltages of semiconductors (switches and diodes) are much lower than a discharge voltage.

Figure 3:
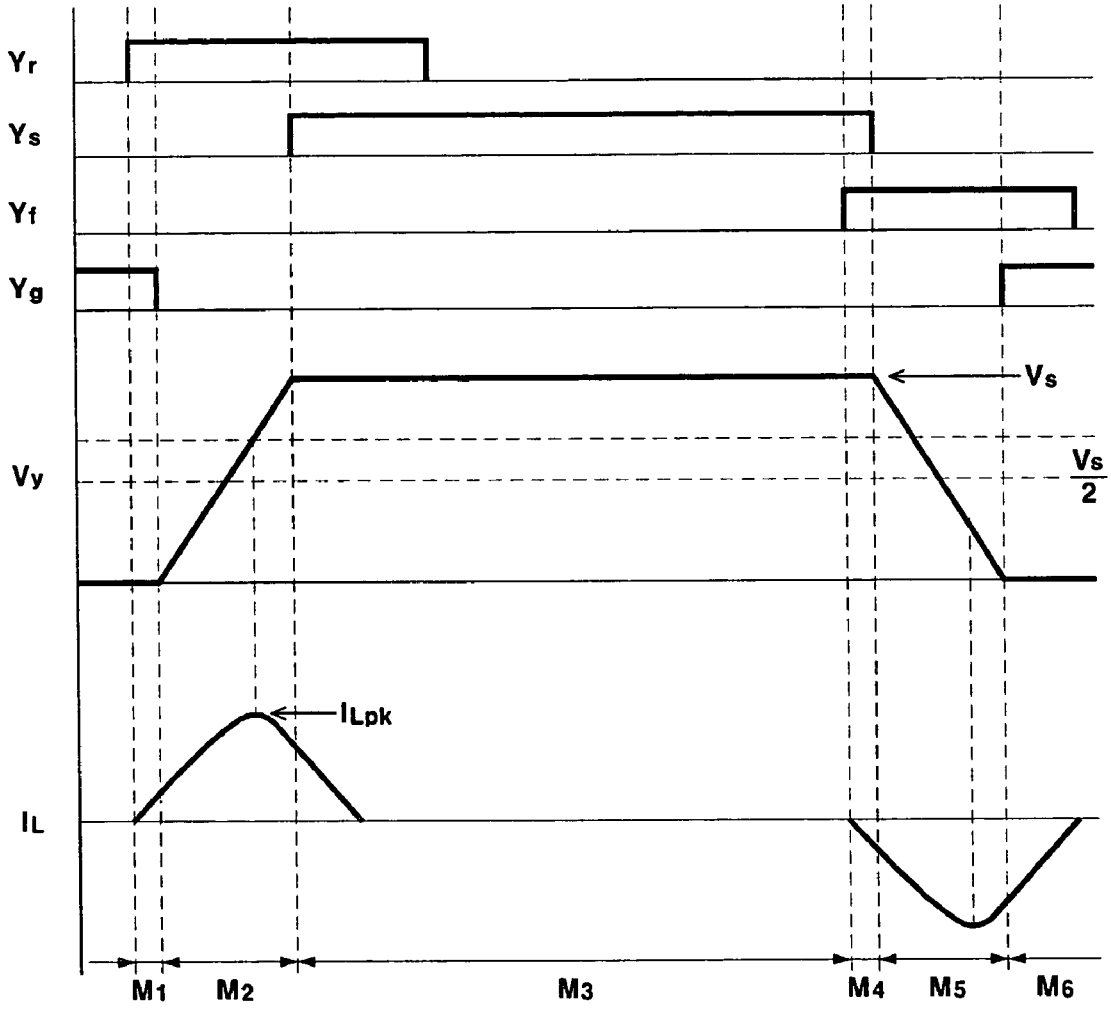
FIG. 3 shows an operational timing diagram of the Y electrode driver according to an embodiment of the present invention.

FIG. 3 shows an operational timing diagram of the Y electrode driver according to an embodiment of the present invention, and FIG. 4A to FIG. 4F show current paths of the Y electrode driver in respective modes according to an embodiment of the present invention.

It is assumed that the switch Yg is turned on, the capacitor Cf is charged with the voltage of V1, the capacitor Cr is charged with the voltage of V2, and V1=V2 before the mode 1 M1 starts.

Figure 4A:
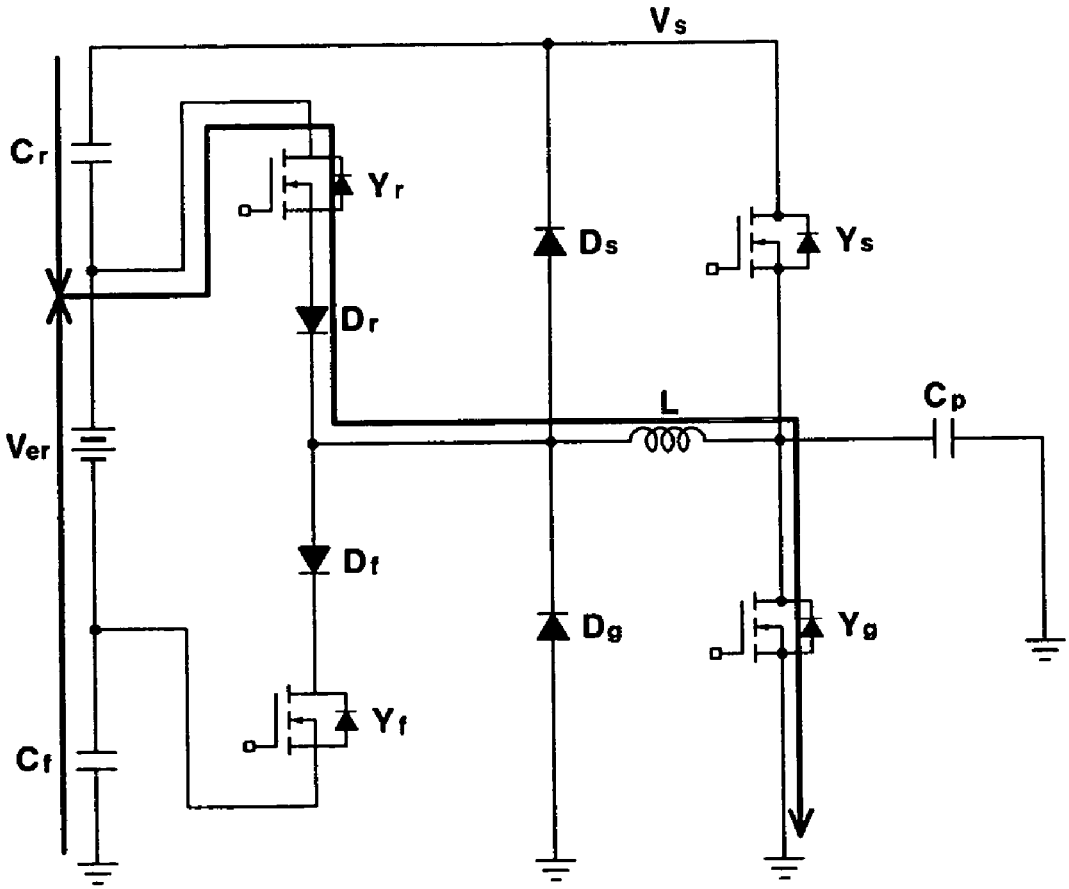
FIG. 4A to FIG. 4F show current paths of the Y electrode driver in respective modes according to an embodiment of the present invention.

① Mode 1 (M1)—Refer to FIG. 4A.

The switch Yr is turned on while the switch Yg is on as shown by M1 of FIG. 3 so that current paths are formed in the order of the capacitor Cr, the switch Yr, the diode Dr, the inductor L, and the switch Yg, and in another order of the capacitor Cf, the power source Ver, the switch Yr, the diode Dr, the inductor L, and the switch Yg. Accordingly, as shown in FIG. 3, the current IL flowing to the inductor L linearly increases with a gradient of (Vs+Ver)/2L, and the inductor L stores magnetic energy.

Figure 4B:
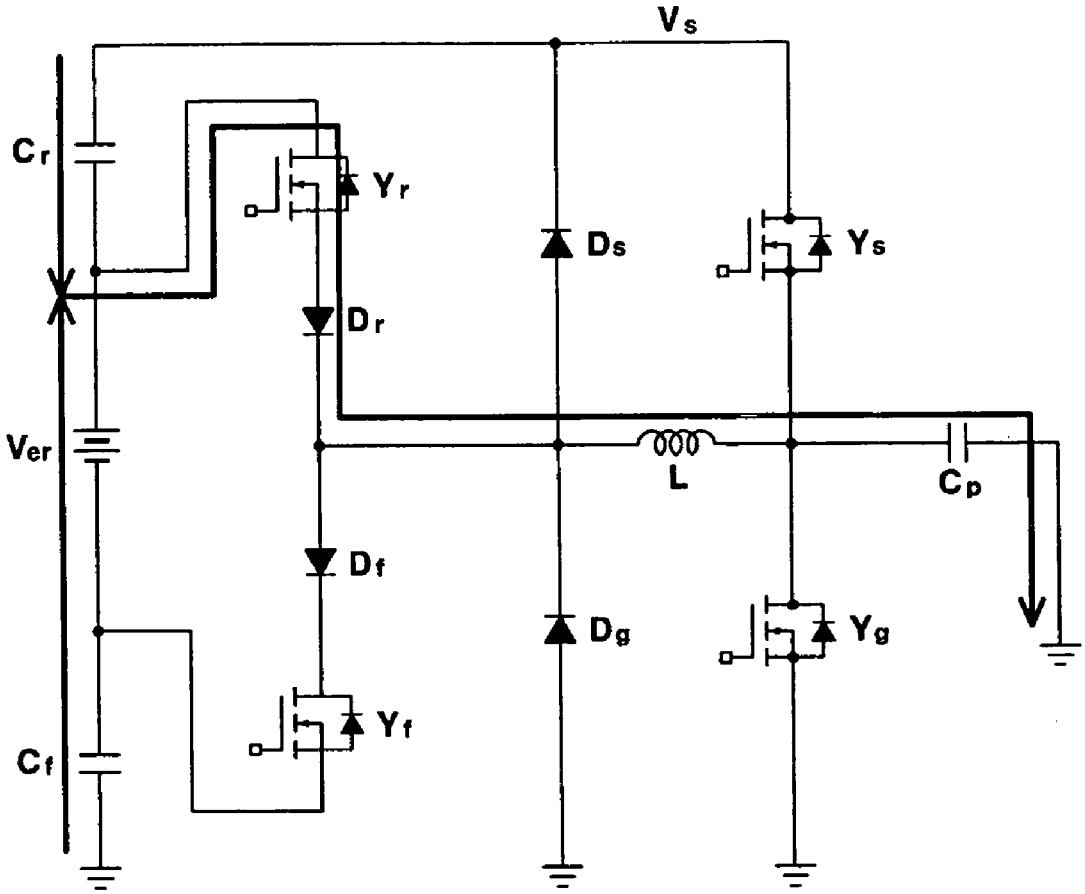

② Mode 2 (M2)—Refer to FIG. 4B.

The switch Yg is turned off while the switch Yr is on as shown by M2 of FIG. 3 so that current paths are generated in the order of the capacitor Cr, the switch Yr, the diode Dr, the inductor L, and the panel capacitor Cp, and in the other order of the capacitor Cf, the power source Ver, the switch Yr, the diode Dr, the inductor L, and the panel capacitor Cp, to thus generate resonance between the inductor L and the panel capacitor Cp as shown in FIG. 4B. By means of the above-noted resonance, the panel capacitor Cp is charged and the Y electrode voltage of Vy of the panel capacitor Cp rises from 0V to the voltage of Vs. In this instance, the charges in the capacitor Cf are moved to the panel capacitor Cp so as to reduce a node voltage between the capacitor Cr and the power Ver, and charges are supplied by the capacitor Cr so as to maintain a node voltage between the capacitor Cr and the power Ver. Since Vs=V1+Ver+V2 and V1=V2, V1=V2 =(Vs−Ver)/2 and the node voltage between the capacitor Cr and the power Ver is given as (Vs+Ver)/2, which is greater than Vs/2. Therefore, the Y electrode voltage of Vy may be increased so as to be higher than the voltage of Vs because of the resonance caused by the initial current of the inductor, and the voltage of Vy is clamped to the voltage Vs by the diode Ds. Also, loss by hard switching is prevented since the switch Ys is turned on after the Y electrode voltage Vy reaches the voltage Vs.

In addition, power recovery time is reduced since the switch Ys is turned on before ½ resonance is finished, as shown in FIG. 3. The power recovery circuit according to an embodiment of the present invention has a great rising gradient since the same performs a rising operation in a potential higher than the voltage of Vs/2, and hence, the inductor L stores much energy.

Figure 4C:
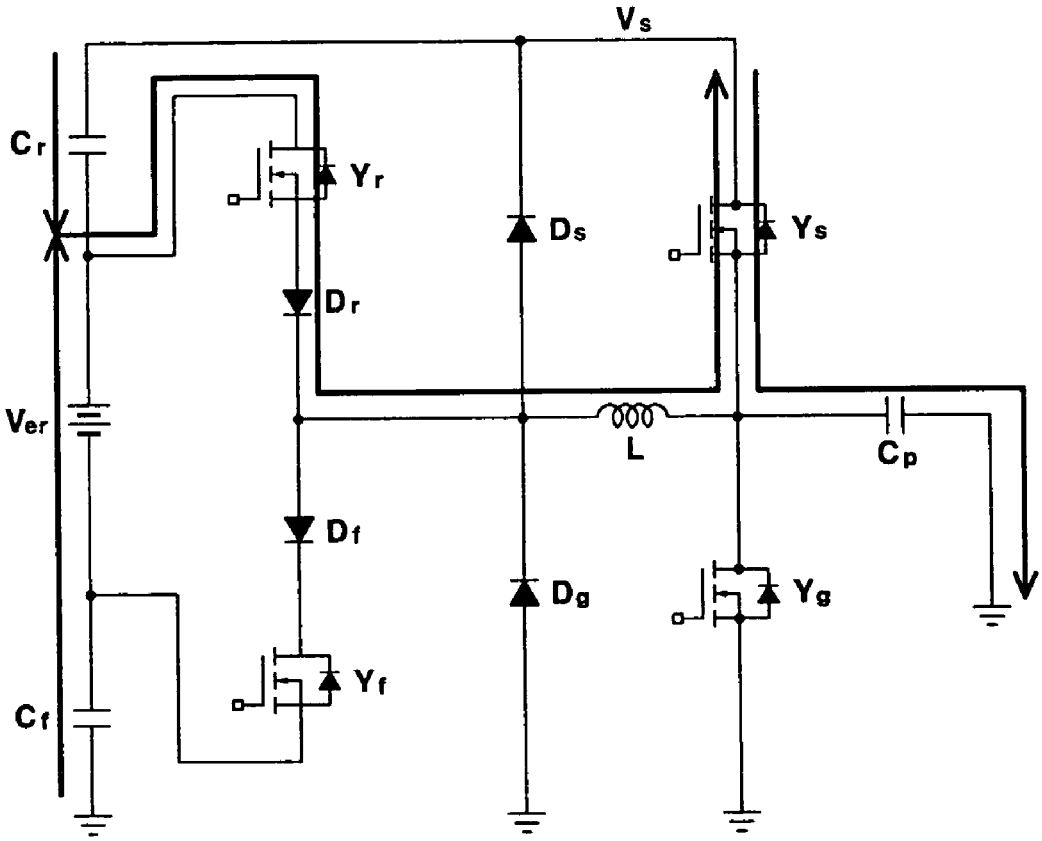

③ (Mode 3 (M3)—Refer to FIG. 4C.

The switch Ys is turned on while the switch Yr is on as shown by M3 of FIG. 3 so that a current path is formed in the order of the switch Yr and the panel capacitor Cp, and the Y electrode voltage Vy of the panel capacitor Cp is maintained at the voltage Vs and the panel emits light.

Also, a current path of a body diode is formed in the order of the capacitor Cr, the switch Yr, the diode Dr, the inductor L, and the switch Ys, and another current path of a body diode is formed in the order of the capacitor Cf; the power source Ver, the switch Yr, the inductor L, and the switch Ys, and the current IL flowing to the inductor L linearly reduces with the gradient of −(Vs−Ver)/2L, which allows further stabilization of discharge since it provides a larger recovery current and eliminates a discharge current because of the larger recovery current. Also, the switch Yr is turned off when the current IL flowing to the inductor L is reduced so as to reach 0 A.

Figure 4D:
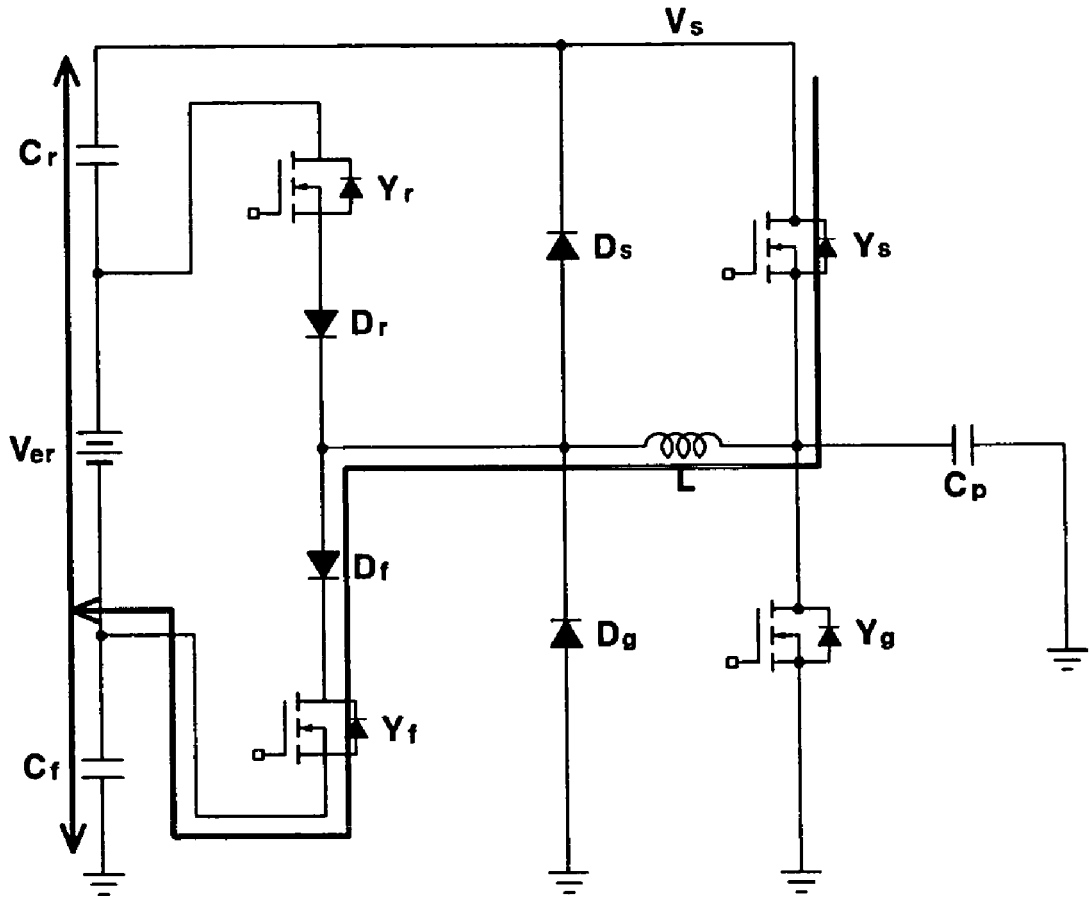

④ Mode 4 (M4)—Refer to FIG. 4D.

The switch Yf is turned on while the switch Ys is on so that a current path is formed in the order of the switch Ys, the inductor L, the diode Df, the switch Yf, and the capacitor Cf, and another current path is formed in the order of the switch Ys, the inductor L, the diode Df, the switch Yf, the power source Ver, and the capacitor Cr. Therefore, the current IL flowing to the inductor L is linearly reduced with the gradient of −(Vs+Ver)/2L.

Figure 4E:
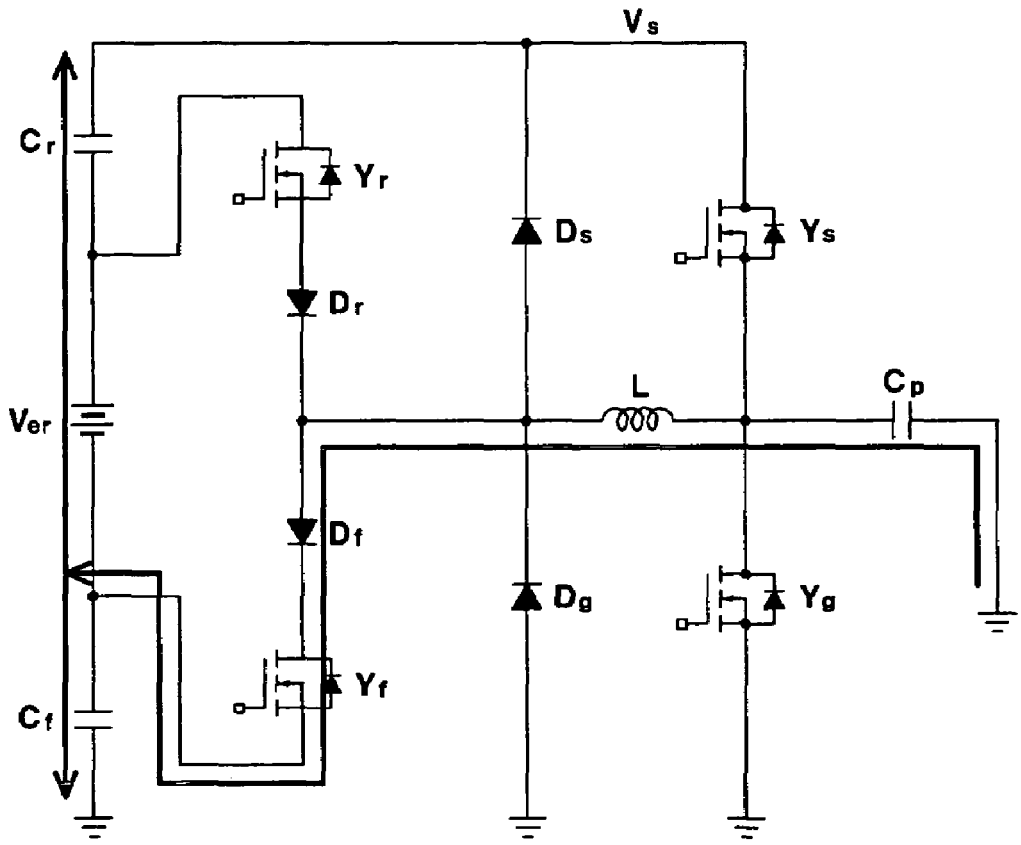

⑤ Mode 5 (M5)—Refer to FIG. 4E.

The switch Ys is turned off while the switch Yf is on so that a current path is formed in the order of the panel capacitor Cp, the inductor L, the diode Df, the switch Yf, and the capacitor Cf, another current path is formed in the order of the panel capacitor Cp, the inductor L, the diode Df, the switch Yf, the power source Ver, and the capacitor Cr, and resonance is generated between the inductor L and the panel capacitor Cp. By means of the above-noted resonance, the panel capacitor Cp is discharged and the Y electrode voltage Vy of the panel capacitor Cp gradually reduces from a voltage of Vs to 0V. In this instance, the charge in the panel capacitor Cp is moved to the capacitor Cf; and a node voltage between the capacitor Cf and the power source Ver is increased so that the charge is moved to the capacitor Cr, and the node voltage between the capacitor Cf and the power source Ver is maintained constantly. However, the node voltage between the capacitor Cf and the power source Ver is given as (Vs−Ver)/2 which is less than Vs/2, and hence, the Y electrode voltage Vy at resonance operation may be reduced below 0V because of the initial current of the inductor, and is clamped to 0V by the diode Dg. Also, loss by hard switching is prevented since the switch Yg is turned on after the Y electrode voltage Vy reaches 0V.

In addition, power recovery time is reduced since the switch Yg is turned on before ½ resonance is finished, as shown in FIG. 3. Accordingly, the power recovery circuit according to an embodiment of the present invention reduces the Y electrode voltage to 0V since the same performs a voltage falling operation in a potential which is lower than the voltage Vs/2.

Figure 4F:
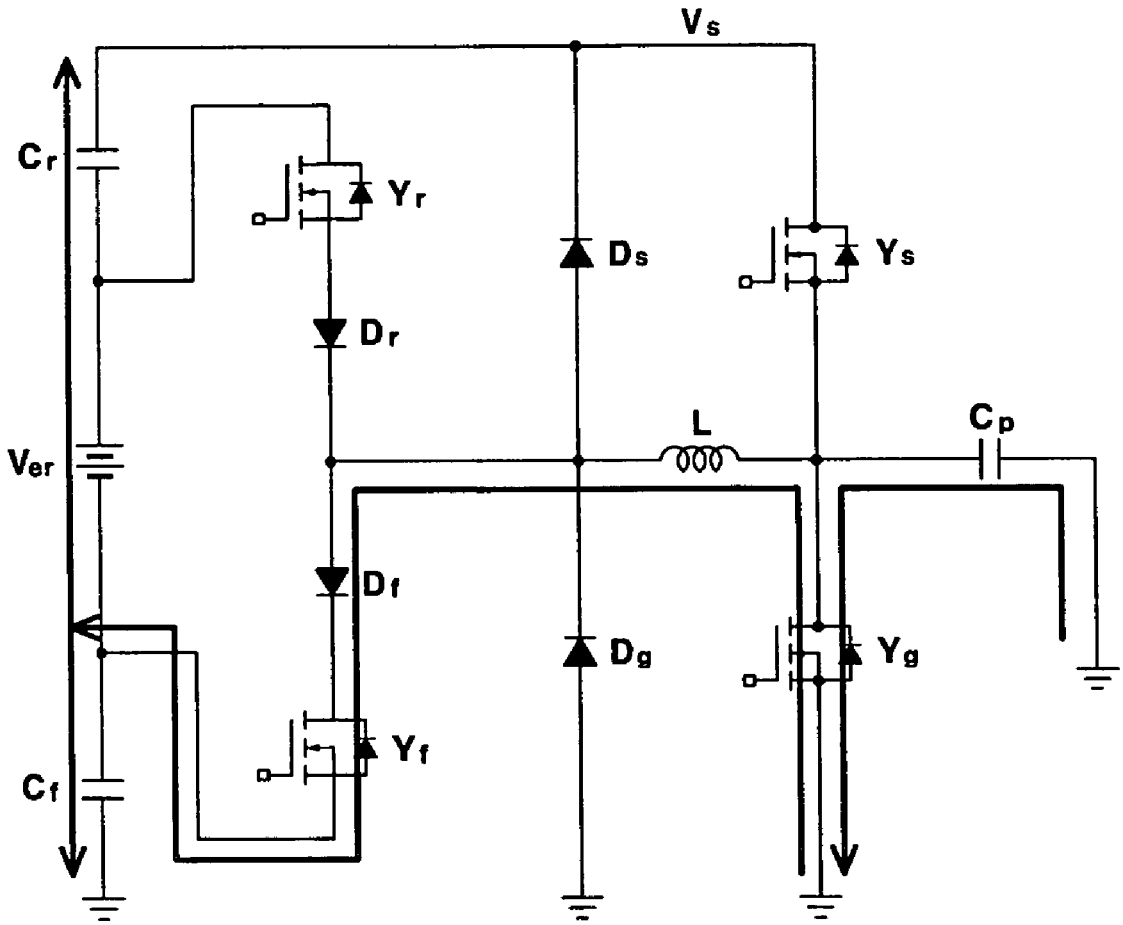

⑥ Mode 6 (M6)—Refer to FIG. 4F.

The switch Yg is turned on while the switch Yf is turned on so that a current path is formed in the order of the panel capacitor Cp and the switch Yg, and the Y electrode voltage Vy of the panel capacitor Cp is maintained at 0V.

Also, a current path is formed in the order of the body diode of the switch Yg, the inductor L, the diode Df, the switch Yf, and the capacitor Cf; another current path is formed in the order of the body diode of the switch Yg, the inductor L, the diode Df, the switch Yf, the power Ver, and the capacitor Cr, and the current IL flowing to the inductor L linearly increases with a gradient of (Vs−Ver)/2L. The switch Yf is turned off when the current IL flowing to the inductor L increases to 0 A. The Y electrode voltage Vy swings between 0V and Vs through Modes 1 to 6 (M1 to M6). The operation of Mode 1 is repeated after Mode 6 (M6).

In addition, the power recovery circuit is operable by resonance of the inductor L and the panel capacitor Cp without the processes of Modes 1 and 4. In this instance, no hard switching occurs when the switches Ys and Yg are turned on, since the voltage supplied by the power source Ver and the capacitor Cf is greater than Vs/2 when the voltage increases, and the voltage supplied by the capacitor Cf is less than Vs/2 when the voltage decreases, even when resonance occurs when the inductor L has no initial current.

Furthermore, the capacitor Cr, the power source Ver, and the capacitor Cf are described in the embodiment of the present invention as being coupled between the power source Vs and the ground, and without being restricted to this, it is also possible to establish the node voltage between the capacitor Cf and the power source Ver to be less than the voltage of Vs/2, and the node voltage between the capacitor Cr and the power source Ver to be greater than the voltage of Vs/2 by using another power source. The number of power sources can be reduced to decrease production cost by using the power of Vs and the ground voltage.

Figure 5:
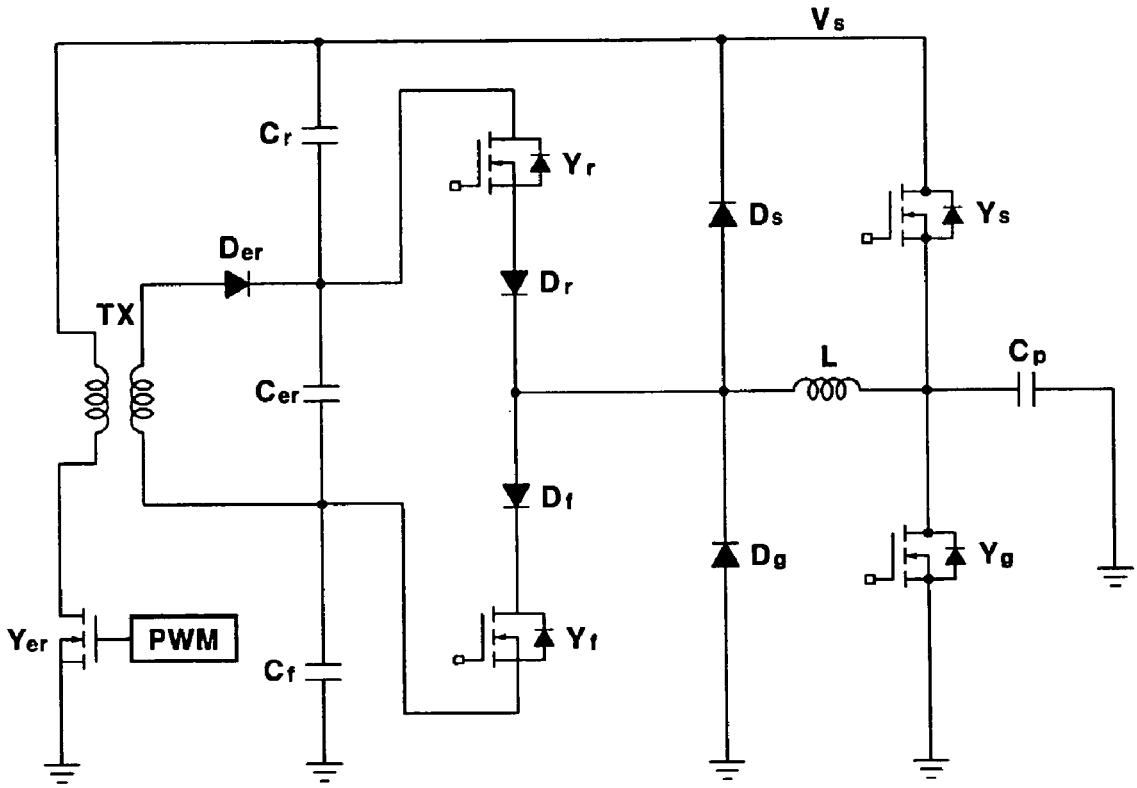
FIG. 5 shows a flyback power configuration using floating power in a power recovery circuit according to an embodiment of the present invention.

FIG. 5 shows a flyback power (Ver) configuration using floating power in a power recovery circuit according to an embodiment of the present invention. As shown in FIG. 5, the power source Ver controls turn-on/off operations of the switch Yer through a PWM controller so as to thereby transmit power of the primary coil of a transformer TX to a capacitor Cer of the secondary coil thereof. A single inductor L is coupled to the Y electrode so as to alternately form a charge path and a discharge path through the inductor, and in addition to this, it is possible to use two inductors to divide the charge path and the discharge path.

As described above, voltage rising time and voltage falling time can be reduced by establishing a voltage of a power recovery capacitor at a voltage rising so as to be higher than a middle voltage of the sustain discharge voltage, and by establishing a voltage of a power recovery capacitor at a voltage falling so as to be lower than the middle voltage of the sustain discharge voltage in the power recovery circuit. Also, the problems of surged current and switch stress, occurring when switches are hard switched, are solved since the switch for supplying the sustain discharge voltage is turned on after the voltage of the panel capacitor is increased to the voltage Vs or decreased to 0V through the power recovery operation.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display device, comprising:

a panel including a plurality of first electrodes and second electrodes; and a driving circuit for outputting a signal for driving the first electrodes;

wherein the driving circuit comprises:

a first switch coupled between a first power source and the first electrodes for supplying a first voltage to the first electrodes in a sustain period;

a second switch coupled between a second power source and the first electrodes for supplying a second voltage, lower than the first voltage, to the first electrodes in the sustain period;

at least one inductor having a first terminal coupled to the first electrodes;

a third power source for supplying a third voltage, which is higher than half a difference between the first voltage and the second voltage;

a third switch having a first terminal coupled to the third power source and a second terminal coupled to a second terminal of said at least one inductor;

a fourth power source for supplying a fourth voltage, which is lower than half the difference between the first voltage and the second voltage; and a fourth switch having a first terminal coupled to the fourth power source and a second terminal coupled to the second terminal of said at least one inductor;

wherein the driving circuit comprises a first capacitor, a floating power source, and a second capacitor coupled in series between a fifth power source for supplying a fifth voltage and a sixth power source for supplying a sixth voltage; and wherein the third power source includes the floating rower source and the second capacitor, and the fourth power source includes the second capacitor.

2. The plasma display device of claim 1, wherein the fifth voltage corresponds to the first voltage, and the sixth voltage corresponds to the second voltage.

3. The plasma display device of claim 1, wherein the driving circuit further comprises:

a first diode coupled between said at least one inductor and the third switch for determining a direction of a current so as to charge the first electrode; and a second diode coupled between said at least one inductor and the fourth switch for determining a direction of a current so as to discharge the first electrode.

4. The plasma display device of claim 1, wherein the driving circuit uses resonance of said at least one inductor and the first electrode, generated when the third switch is turned on during a sustain period, to increase a voltage at the first electrode; and wherein the driving circuit uses resonance of said at least one inductor and the first electrode, generated when the fourth switch is turned on during a sustain period, to decrease the voltage at the first electrode to the second voltage.

5. The plasma display device of claim 4, wherein the driving circuit performs at least one of an operation for turning on the second switch for a predetermined time while the third switch is on, and an operation for turning on the first switch for a predetermined time while the fourth switch is on, before the resonance is formed.

6. A plasma display device, comprising:

a panel including a plurality of first electrodes and second electrodes; and a driving circuit for outputting a signal for driving the first electrodes;

wherein the driving circuit comprises:

at least one inductor having a first terminal coupled to the first electrodes; and a first capacitor, a floating power source, and a second capacitor coupled in series between a first power source for supplying a first voltage and a second power source for supplying a second voltage;

wherein a first path is formed from a node between the first capacitor and the floating power source to said at least one inductor, and increases a voltage at the first electrodes;

wherein a second path is formed for applying a third voltage, supplied by a third power source to the first electrodes;

wherein a third path is formed from said at least one inductor to a node between the floating power source and the second capacitor, and reduces a voltage at the first electrodes; and wherein a fourth path is formed for applying a fourth voltage, supplied by a fourth power source, to the first electrodes.

7. The plasma display device of claim 6, wherein the first path is formed when a first switch, coupled between said at least one inductor and the node of the first capacitor, and the floating power source is turned on, and the third path is formed when a second switch, coupled between said at least one inductor and the node of the second capacitor, and the floating power source, is turned on.

8. The plasma display device of claim 7, wherein the second path is formed when a third switch, coupled between the third power source and the first electrodes, is turned on, and the fourth path is formed when a fourth switch, coupled between the fourth power source and the first electrodes, is turned on.

9. The plasma display device of claim 6, wherein the third power source comprises the first power source, and the fourth power comprises the second power source.

10. The plasma display device of claim 6, wherein at least one of a fifth path and a sixth path are formed, the fifth path supplying a predetermined current to said at least one inductor before a voltage at the first electrodes is increased, the fifth path being formed from a node between the first capacitor and the floating power source to said at least one inductor, and the sixth path supplying a predetermined current to said at least one inductor before the voltage at the first electrodes is decreased, the sixth path being formed from said at least one inductor to a node between the floating power source and the second capacitor.

11. A plasma display device driving method which uses an inductor coupled to a first electrode and alternately applies a first voltage and a second voltage to the first electrode, and wherein a panel capacitor is formed by the first electrode and a second electrode, the method comprising the steps of:

using a third voltage, which is higher than an average of the first voltage and the second voltage, to generate resonance between the panel capacitor and the inductor, and increasing a voltage at the first electrode;

applying the first voltage to the first electrode;

using a fourth voltage, which is lower than the average of the first voltage and the second voltage, to generate resonance between the panel capacitor and the inductor, and decreasing a voltage at the first electrode; and applying the second voltage to the first electrode;

wherein the fourth voltage is supplied by a first capacitor charged with the fourth voltage. and the third voltage is supplied by the first capacitor and a floating power source coupled to the first capacitor.

12. A plasma display device driving method which uses an inductor coupled to a first electrode and alternately applies a first voltage and a second voltage to the first electrode, and wherein a panel capacitor is formed by the first electrode and a second electrode, the method comprising the steps of:

using a third voltage, which is higher than an average of the first voltage and the second voltage, to generate resonance between the panel capacitor and the inductor, and increasing a voltage at the first electrode;

applying the first voltage to the first electrode;

using a fourth voltage, which is lower than the average of the first voltage and the second voltage, to generate resonance between the panel capacitor and the inductor, and decreasing a voltage at the first electrode; and applying the second voltage to the first electrode;

wherein the first capacitor, the floating power source, and the second capacitor are coupled in series between a first power source for supplying the first voltage and a second power source for supplying the second voltage, the third voltage being supplied by an anode of the floating power source, and the fourth voltage being supplied by an anode of the second capacitor.

13. The plasma display device driving method of claim 11, further comprising the step of:

before the voltage at the first electrode is increased, applying a current to said at least one inductor in a direction which corresponds to a direction of the current which flows to the inductor when the voltage at the first electrode is increased.

14. The plasma display device driving method of claim 11, further comprising the step of:

before the voltage at the first electrode is decreased, applying a current to said at least one inductor in a direction which corresponds to a direction of the current which flows to the inductor when the voltage at the first electrode is decreased.

* * * * *